US009121681B2

(12) United States Patent
Wierenga

(10) Patent No.: US 9,121,681 B2
(45) Date of Patent: Sep. 1, 2015

(54) HAND GRENADE

(76) Inventor: Gregory K. Wierenga, Roseville, CA (US)

( * ) Notice: Subject to any disclaimer, the term of this patent is extended or adjusted under 35 U.S.C. 154(b) by 153 days.

(21) Appl. No.: 13/565,912

(22) Filed: Aug. 3, 2012

(65) Prior Publication Data

US 2014/0076189 A1 Mar. 20, 2014

Related U.S. Application Data

(60) Provisional application No. 61/539,331, filed on Sep. 26, 2011.

(51) Int. Cl.

| | |
|---|---|
| ***F42C 14/02*** | (2006.01) |
| ***F42C 15/20*** | (2006.01) |
| ***F42B 27/00*** | (2006.01) |

(52) U.S. Cl.

CPC ..... *F42C 14/02* (2013.01); *F42B 27/00* (2013.01); *F42C 15/20* (2013.01)

(58) Field of Classification Search

CPC ..... F42C 14/02; F42C 15/20; F42C 15/21; F42B 27/00; F42B 27/08

USPC ..... 102/482, 487, 488, 498, 202.1, 258, 102/259, 260, 261

See application file for complete search history.

(56) References Cited

U.S. PATENT DOCUMENTS

| | | | | |
|---|---|---|---|---|
| 2,737,116 | A | 3/1956 | Manzolini | |
| 3,765,337 | A | 10/1973 | Padula | |
| 3,823,669 | A * | 7/1974 | Zacharin | 102/221 |
| 3,823,670 | A * | 7/1974 | Zacharin | 102/487 |
| 3,865,027 | A * | 2/1975 | Dubno et al. | 102/487 |
| 4,333,401 | A | 6/1982 | Byers et al. | |
| 4,926,752 | A * | 5/1990 | DiRubbio et al. | 102/486 |
| 5,196,649 | A * | 3/1993 | DiRubbio et al. | 102/486 |
| 5,590,886 | A | 1/1997 | Lush | |
| 6,272,995 | B1 * | 8/2001 | Schmidt et al. | 102/209 |
| 6,792,868 | B2 * | 9/2004 | Teilhol et al. | 102/487 |
| 6,871,594 | B1 | 3/2005 | Estrella | |
| 8,561,540 | B1 * | 10/2013 | Lauch | 102/258 |
| 8,661,979 | B2 * | 3/2014 | Veksler | 102/256 |
| 8,752,485 | B2 * | 6/2014 | Muller et al. | 102/482 |
| 2006/0283346 | A1 | 12/2006 | Luebbers et al. | |

* cited by examiner

*Primary Examiner* — James S Bergin
(74) *Attorney, Agent, or Firm* — Taylor IP, P.C.

(57) ABSTRACT

A hand-throwable grenade including a detonator initiating mechanism, a detonator and a locking key. The detonator initiating mechanism is activatable by an operator before the grenade is thrown. The detonator is associated with the detonator initiating mechanism. The locking key interacts with the detonator initiating mechanism to preclude an arming of the detonator until the locking key is removed from the detonator initiating mechanism. The locking key has at least one notch therein.

7 Claims, 7 Drawing Sheets

HAND GRENADE

CROSS REFERENCE TO RELATED APPLICATIONS

This is a non-provisional application based upon U.S. provisional patent application Ser. No. 61/539,331 entitled "HAND GRENADE", Sep. 26, 2011, which is incorporated herein by reference.

BACKGROUND OF THE INVENTION

1. Field of the Invention

The present invention relates to fuzed devices, and, more particularly, fuzed hand grenades.

2. Description of the Related Art

A hand grenade is a small bomb that can be thrown by hand. There are at least three types of hand grenades—explosive grenades, chemical grenades, and gas grenades. Explosive hand grenades are the most common used in modern warfare, and they detonate after impact or after a predetermined time after the detonator of the hand grenade is armed. Chemical and gas grenades do not explode, rather they burn or release a gas.

Typically grenades explode, projecting shrapnel consisting of pieces of the casing, serrated wire, or an incendiary material. Grenades are manufactured having an explosive or chemical filler with an opening for a fuze. Modern hand grenades have a fuze that is lit by an internal device rather than an external flame typically used in older grenades.

Hand grenades manufactured for US forces, such as that shown in FIG. 1, typically have a safety handle or lever 4 (which is known by some as the spoon, due to its size and shape) and a removable safety pin 1 that prevents the safety lever 4 from being released. Some grenade types, such as the one shown in FIG. 1, also have a safety clip 3 to further prevent the handle from inadvertently coming off in transit.

To use a grenade of FIG. 1, the soldier grips it with the throwing hand, ensuring that his thumb holds the safety lever 4 in place. This is called the death grip, because releasing the lever could make the grenade detonate, killing the thrower. Left-handed soldiers are advised to invert the grenade, so the thumb is still the digit that holds the safety lever. The soldier then grabs the pull ring 1 with the index or middle finger of the other hand and removes it with a pulling and twisting motion. He then throws the grenade towards the target.

Once the soldier throws the grenade, safety lever 4 releases, the striker throws safety lever 4 away from the grenade body 5 as it rotates to detonate the primer (not specifically shown). The primer explodes and ignites the fuze (which serves as a delay element). The fuze burns down to the detonator, which explodes the main charge in body 5.

Several problems exist with the prior art hand grenades, among them the difficulty in operating the system with one hand. Another problem is that the pull ring can catch on something and be inadvertently pulled out. Another problem is that it is difficult to reinsert the pin of the pull ring once it is removed.

What is needed in the art is an effective device to overcome these problems with the prior art hand grenades.

SUMMARY OF THE INVENTION

The present invention provides an effective locking mechanism for a hand grenade that is easily removable when removal is intended, yet does not come out inadvertently.

The present invention in one form is directed to a hand-throwable grenade including a detonator initiating mechanism, a detonator and a locking key. The detonator initiating mechanism is activatable by an operator before the grenade is thrown. The detonator is associated with the detonator initiating mechanism. The locking key interacts with the detonator initiating mechanism to preclude an arming of the detonator until the locking key is removed from the detonator initiating mechanism. The locking key has at least one notch therein.

An advantage of the present invention is that the key is easily removable by the hand that is holding the grenade.

Another advantage of the present invention is that the key is positively locked to the safety lever until the safety clip is removed.

Yet another advantage of the present invention is that the key can be easily reinserted into the opening in the safety lever and the opening in the detonator to re-safe the grenade.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
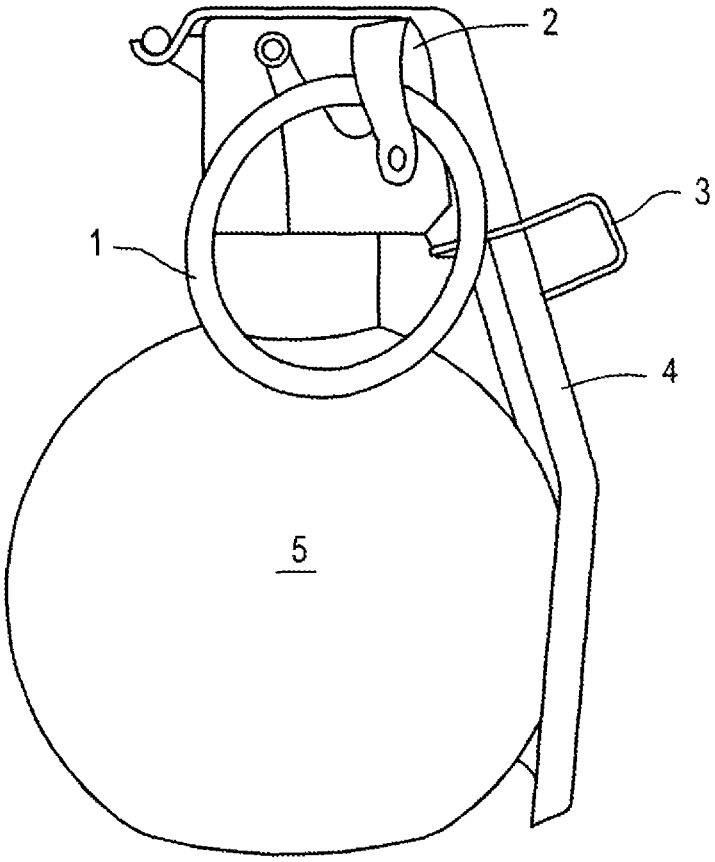
Prior Art Fig. 1
FIG. 1 is a side view of a prior art hand grenade.

Referring now to the drawings and more particularly to FIG. 1 there is shown a prior art hand grenade having a pull ring pin 1, a confidence clip 2, a safety clip 3, a safety lever 4 and a grenade body 5. Confidence clip 2 is provided to hold pull ring pin 1 in place in an attempt to prevent a premature removal of pull ring pin 1. An operator has to clear pull ring pin 1 from confidence clip 2, flip safety clip 3 off, remove pull ring pin 1, let safety lever 4 come off to activate the fuze of the grenade. These operations are typically carried out with two hands. A disadvantage of this configuration is that the ring of pull ring pin 1 can get caught on something inadvertently causing pull ring pin 1 to be removed.

Figure 2:
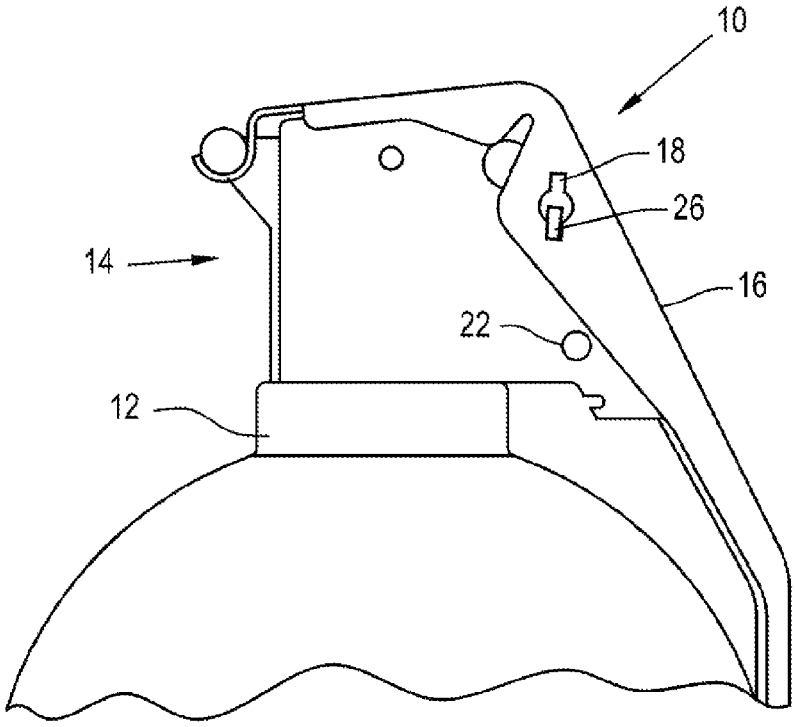
FIG. 2 is a partial side view of an embodiment of a hand grenade of the present invention.

Now referring to FIGS. 2-13 there is illustrated a new fuzed device 10 in the form of a hand grenade 10 including a bomb portion 12, a fuze assembly 14, a safety lever 16, an opening 18, a safety clip 20, an opening 22, a key 24 and an opening 26. Key 24 includes notches 28 and a clip 30. As can be seen in FIG. 2 opening 18 and opening 26 are not fully aligned while opening 22 is visible beside safety lever 16. Several of the subsequent figures illustrate the insertion of key 24 and safety clip 20, which is the reverse of what a fuzed device 10 would normally do in the use of fuzed device 10.

Fuze assembly 14 contains a detonator, which for the ease of explanation fuze assembly 14 can be considered a detonator 14 that is activated when safety lever 16 is removed. Safety lever 16 is a detonator initiating mechanism 16 that is prepared for activation by the removal of clip 30 and key 24 as discussed herein. The detonation process initiates when lever 16 is removed, which may be by the operator releasing lever 16, or as is often the case the separation of lever 16 from the rest of grenade 10 during the throwing process.

Figure 3:
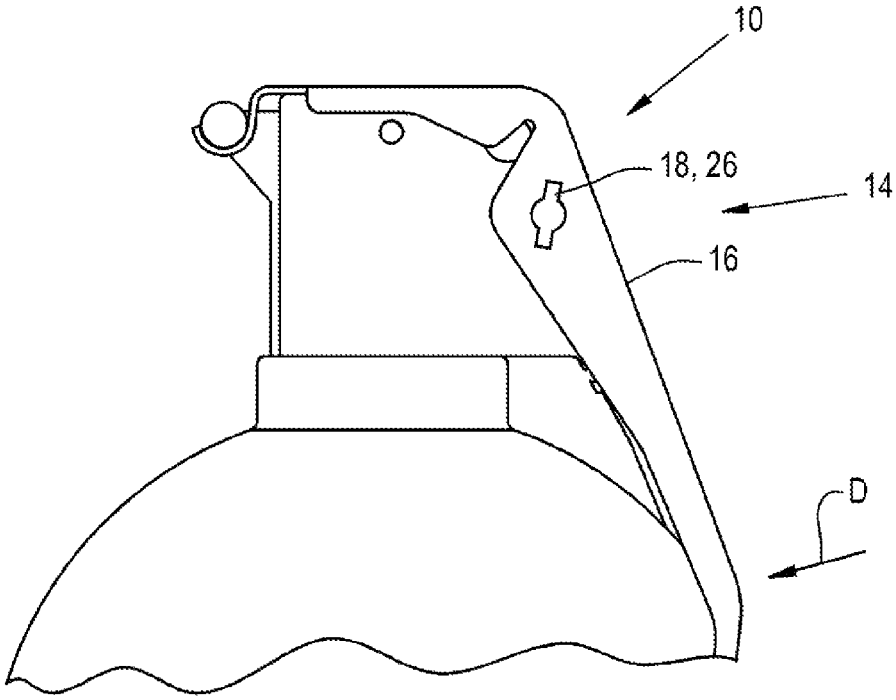
FIG. 3 is another partial side view of the hand grenade of FIG. 2 showing the alignment of slots.
Figure 4:
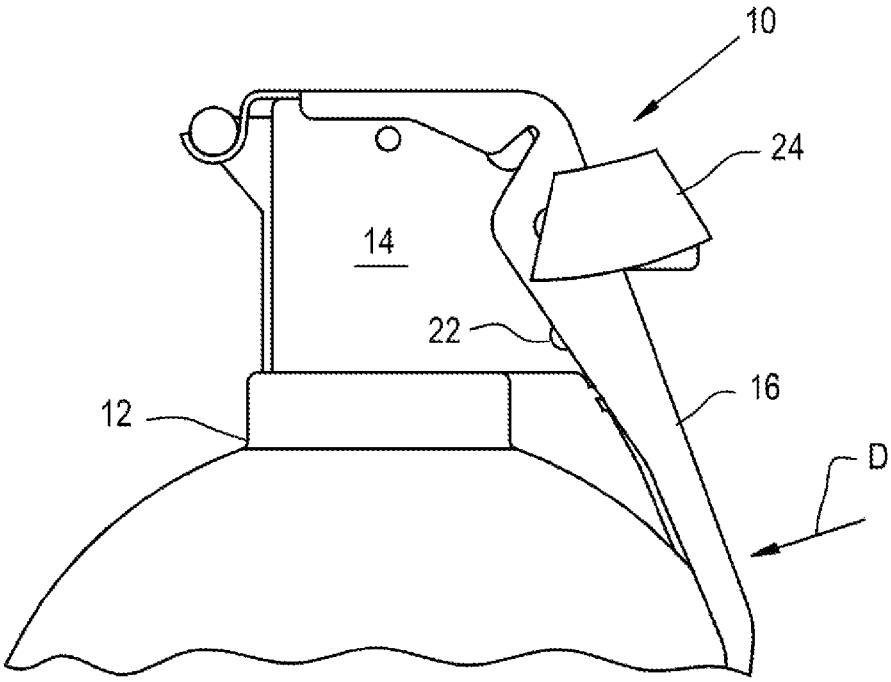
FIG. 4 is another partial side view of the hand grenade of FIGS. 2 and 3 with an embodiment of a key of the present invention installed with the safety lever in the position shown in FIG. 3.
Figure 5:
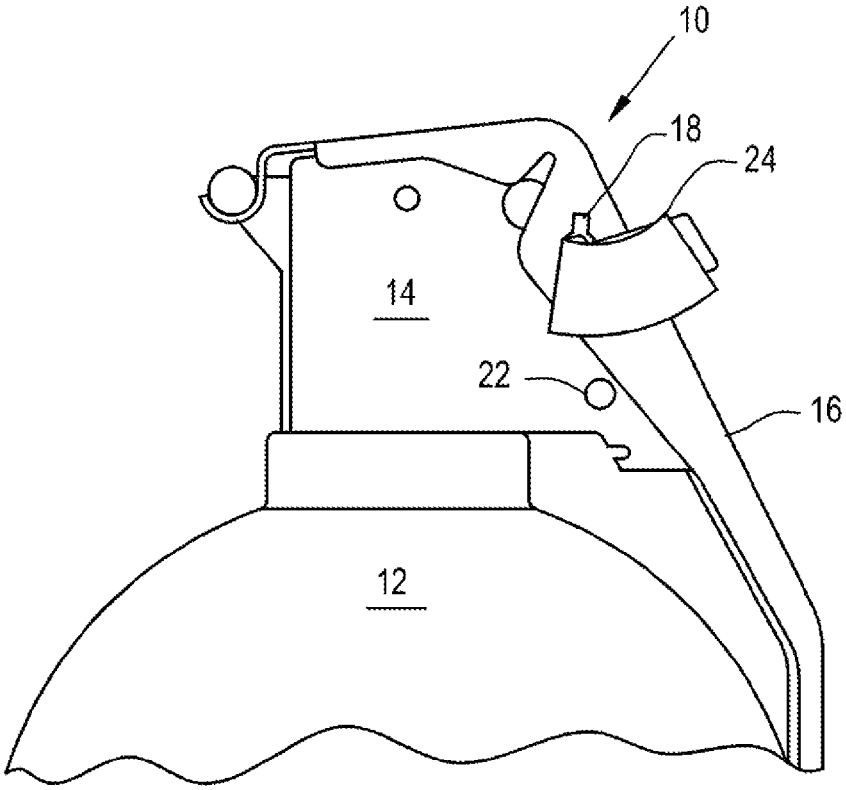
FIG. 5 is another partial side view of the hand grenade of FIGS. 2-4 with the key installed with the safety lever in the position shown in FIG. 2.

In FIG. 3, safety lever 16 is pressed closer to bomb portion 12 to cause openings 18 and 26 to substantially align. Movement of lever 16 in direction D has allowed openings 18 and 26 to align. This action causes opening 22 to be obscured from view by the position of safety lever 16. The movement of safety lever 16 and a spring in fuze assembly 14 (not shown) allows this movement to occur. In FIG. 4, key 24 has been inserted through openings 18 and 26 and some of the force, which is applied in direction D, has been released from safety lever 16 allowing a view of a part of opening 22. In FIG. 5, safety lever 16 has been released and key 24 is preventing safety lever 16 from leaving fuze assembly 14. Additionally referring to FIGS. 12 and 13, notches 28 can be seen in key 24, which are what allows opening 18 to once again not align fully with opening 26 as notches 28 allow a portion of safety lever 16 to enter therein to thereby lock key 24 in position and fully exposing opening 22. Notches 28 allow a portion of lever 16 to enter thereinto so as to preclude the sliding removal of key 24 from openings 18 and 26.

Figure 6:
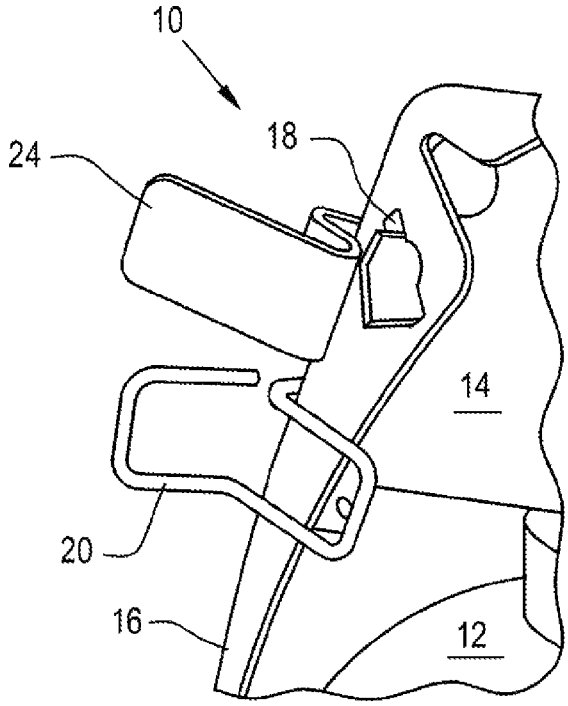
FIG. 6 is a partial perspective view of another side of the hand grenade of FIGS. 2-5.

In FIG. 6, safety clip 20 has been inserted into opening 22 and is clipped over a portion of the outer surface of safety lever 16. Safety clip 20 then prevents safety lever 16 from being depressed enough to remove key 24. This is an interaction that does not exist in the prior art, with safety clip 20 precluding the removal of key 24. In contrast the prior art hand grenade as illustrated in FIG. 1, allowed the pin 1 to be removed with the safety clip installed. In the present invention the coacting of safety clip 20, safety lever 16 and key 24 require a prescribed sequence of operations to arm fuze assembly 14. That sequence is the removal of safety clip 20, the depressing of safety lever 16, the pressing of clip 30 outwardly, the sliding of key 24 from openings 18 and 26, and the release of safety lever 16.

Figure 7:
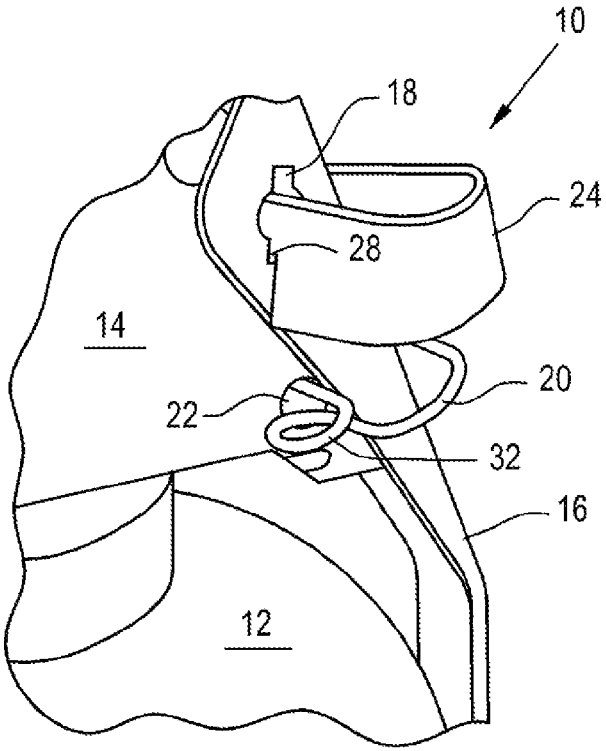
FIG. 7 is another perspective view of the hand grenade of FIGS. 2-6.
Figure 8:
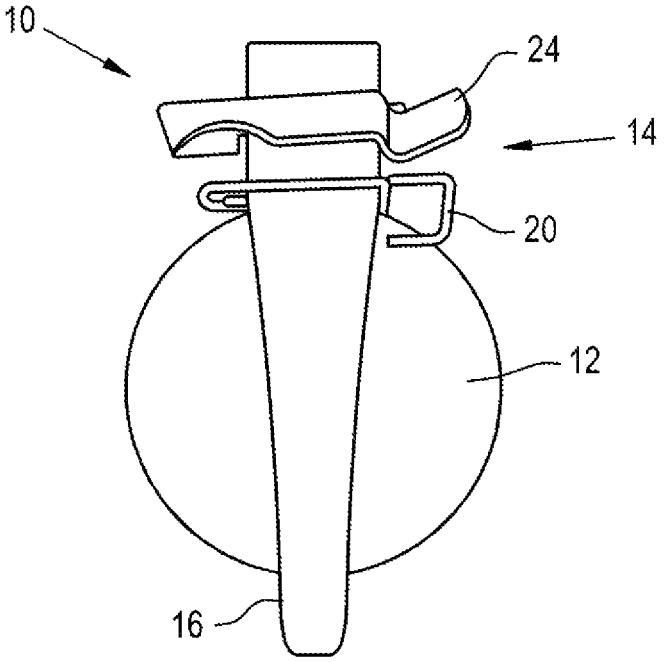
FIG. 8 is a side view of the hand grenade of FIGS. 2-7.
Figure 9:
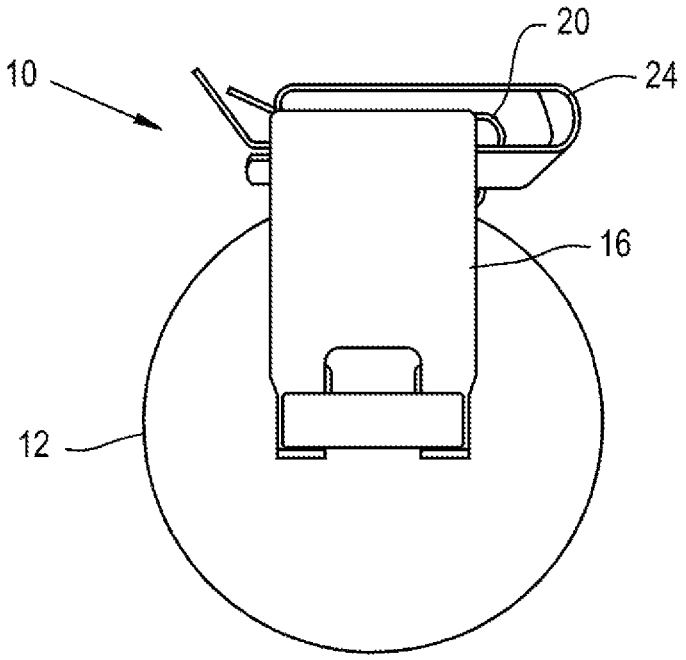
FIG. 9 is another view of the hand grenade of FIG. 2-8.

In FIG. 7 there is shown another view of fuzed device 10 illustrating an opposite side of safety lever 16 from that shown in FIG. 6. FIG. 8 is yet another view of fuze device 10, which clearly shows key 24, which not only extends through openings 18 and 26, but also wraps around safety lever 16 having a clip 30 which additionally serves to secure the position of key 24. It is also contemplated that key 24 may not wrap around safety lever 16. FIG. 9 is a top view of fuzed device 10 with key 24 and safety clip 20 in there normal installed positions.

Figure 10:
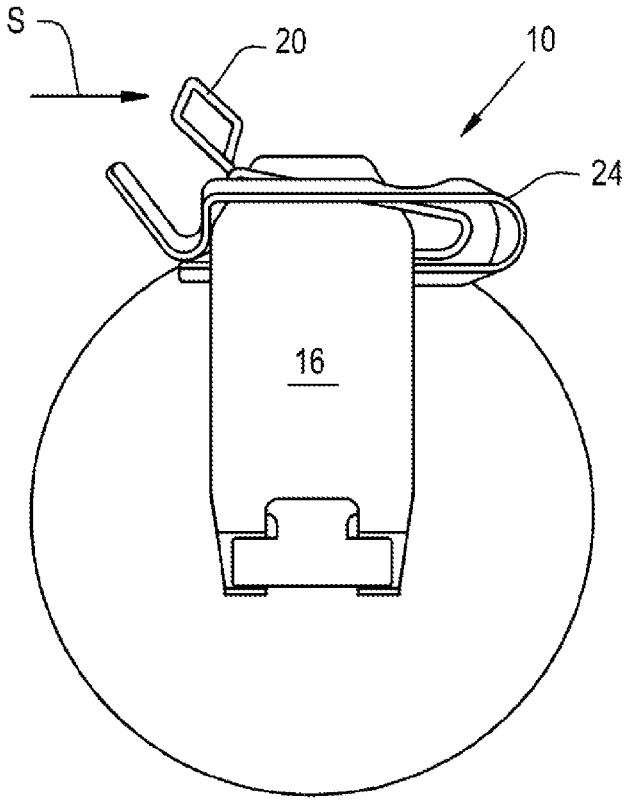
FIG. 10 is a top view of the hand grenade of FIGS. 2-9.
Figure 11:
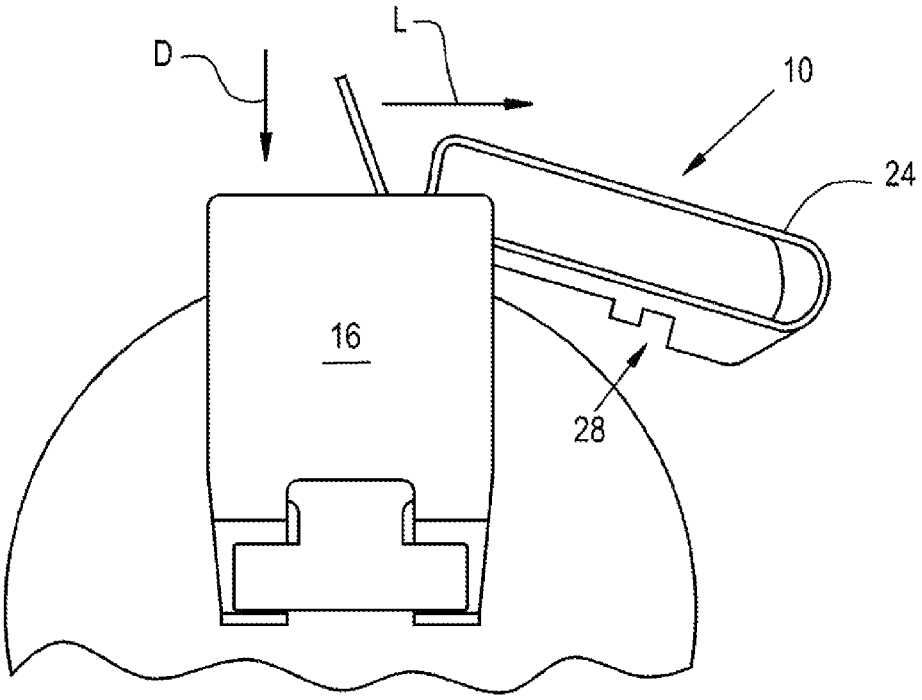
FIG. 11 is a partial view of the hand grenade of FIGS. 2-10, with the key of the present invention nearly removed.

FIGS. 10 and 11 illustrates a method of arming fuzed device 10 with safety clip 20 being removed by pushing with a finger or thumb (not shown) in direction S, then as safety lever 16 is grasped and pressure being applied in direction D, key 24 is pressed upward and in direction L over and across safety lever 16. Once key 24 is removed fuzed device 24 is armed by the releasing of safety lever 16 in a conventional manner.

Figure 12:
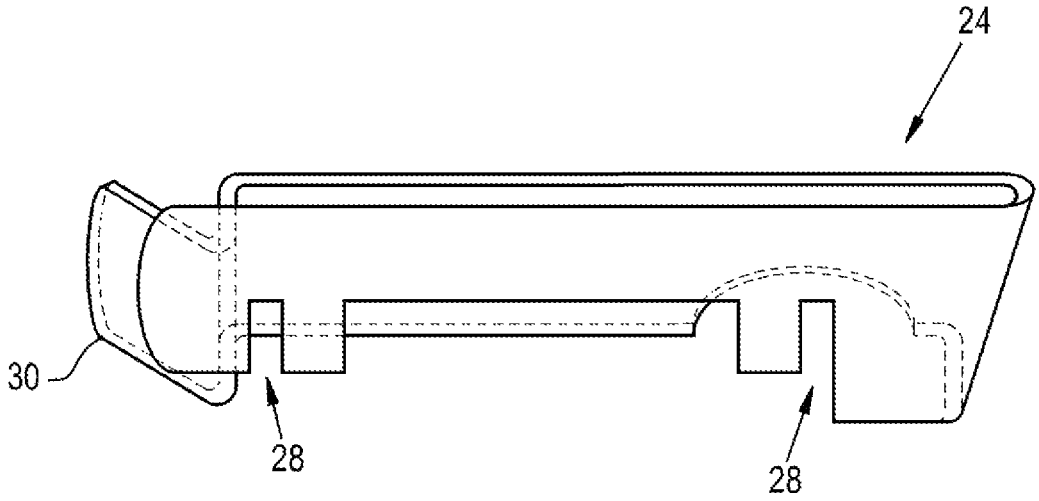
FIG. 12 is a view of the key used in the hand grenade of FIGS. 2-11.
Figure 13:
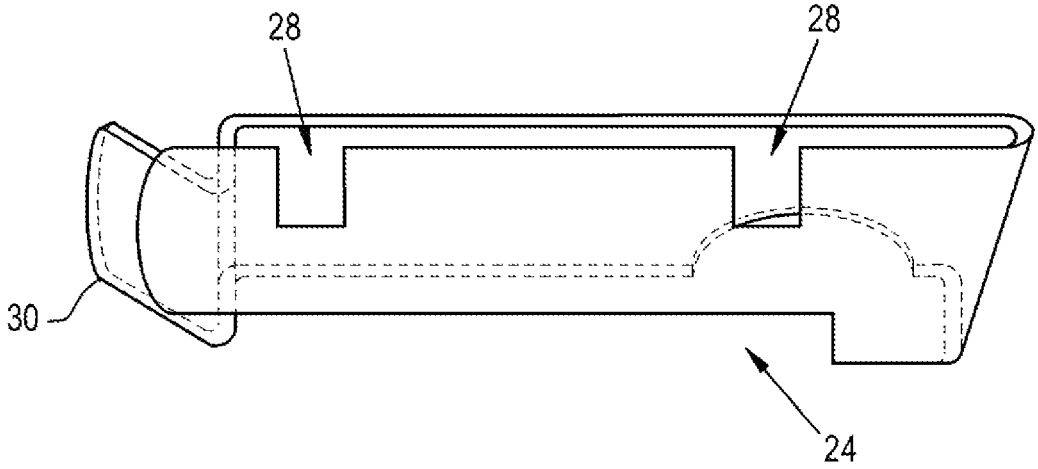
FIG. 13 is a view of another embodiment of a key of the present invention that can be used with the hand grenade of FIGS. 2-11.

FIGS. 12 and 13 illustrate possible configurations of key 24 each having notches 28 that interact with elements of fuze assembly 14 and/or safety lever 16 to secure key 24 until safety lever 16 is depressed and key 24 is removed.

The present invention was conceived whereby a key 24 with positive locking features, aka "PosiKey", replaces the existing pull ring 1 and split pin in current hand grenade technologies. Advantageously, the present invention negates the need to control the pull force associated with pull ring pin 1 of the prior art. The present invention further exploits the existing components to create an interlocking system allowing existing inventory to be retrofitted with the PosiKey system. In and of itself, the locking aspect of the new system that exploits the current technology fuze body, safety lever, spring-loaded striker and the innovative key negates the need for confidence clip 2 for the pull ring 1 inasmuch as a pull ring 1 does not exist in the present invention. While with the current technology confidence clip 2 acts as an additional component to defeat extraction of the pull ring 1 and the associated split pin from the grenade, the innovative PosiKey system acts singularly to prevent removal of the key in the normally stowed position. The PosiKey system further exploits the use of a safety clip with an added loop 32 to prevent compression of the spring-loaded striker/safety lever 4, 16, i.e., the ready position when gripped by the operator. Loop 32 performs two functions, it provides a stop for holding safety clip 20 in a proper position relative to lever 16 as loop 32 rests against the face of fuze assembly 14, and loop 32 adds a spring element to clip 20 so that clip 20 pushes against lever 16 toward the body of grenade 10. Once the grenade with the PosiKey system is gripped and the safety clip 20 is removed, the safety lever 4, 16 can be compressed to the ready position and the key 24 easily removed. The PosiKey further incorporates a tab 30 that latches across the width of the safety lever such that no compression is imparted to the spring-loaded striker/lever. This feature is provided to present a final mode of intent to function the grenade once the grenade is gripped, safety clip removed, and lever compressed. With this latching feature, the PosiKey must be extracted with intent, but unlike the current technology that necessitates two hand operation, the key 24 can be extracted either with thumb action of the throwing hand, which is also used to remove the safety clip, or with the hand alternate to the throwing hand, much like the current technology pull ring. Unlike the current technology, the invention provides for multiple opportunities to abort the intended function of the grenade. Most importantly, the key 24 can be re-inserted after removal, and the safety clip re-inserted to completely and readily re-safe the grenade, while the current technology pull ring and pin cannot be readily re-safed due to deformation of the split pin.

Primary motivation for the present invention emanated from observed problems for hand grenades from manufacturing production acceptance and inventory testing for low pull pin retention force. Secondary motivation emanated from operators' practice of taping the pull ring current technology in place, causing a more hazardous scenario for the retrograde of grenades back into the supply chain. To mitigate this, grenades are now being produced by the U.S. Government that adds a confidence clip 2 shown in FIG. 1 to the grenade. The shortcoming with this technology is that the pull ring 1 still exists and can become snagged by external objects, i.e., even in the stowed position, opportunity can arise that causes the pull ring 1 to detach from confidence clip 2 and further cause the pin 1 to extract from the grenade thereby leaving only the easily sprung safety clip 3 to prevent grenade function if the clip has been left in place. Additional shortcoming is that the confidence clip 2 reduces fuze thread engagement into the grenade body. Calculations are that only three-quarters of a thread is engaged when using the confidence clip 2.

All known prior art hand grenades use a pull ring and pin 1 through the safety lever 4 and fuze body with or without a safety clip trapping the lever to the fuze body. The prior art technology uses a safety clip 3 as a secondary safety feature in the event that the pull ring and pin 1 are inadvertently removed. However, common practice through training is to remove this clip prior to pulling the safety pin. Neither the safety clip 3 nor the confidence clip 2 positively prevents the pull pin 1 from being removed in current technology.

Aside from the inherent safety advantages of the multiple detent PosiKey of the present invention, the innovation further allows the grenade to be retrofitted and eliminate the confidence clip 2, thereby reclaiming the advantages of the original mating assembly configuration of the fuze to grenade body with proper compression of the gasket and proper original design engagement of the threads. By eliminating the confidence clip 2, modes of failure introduced by the confidence clip's physical characteristics to control removal of the pull pin 1 are also eliminated. By eliminating the pull ring 1 and its intricately formed safety pin, additional failure modes are eliminated, most notably "pull force" that is a recurring barrier to product acceptability in fuze and grenade manufacturing. Pull pin force continues to be a controlled characteristic in spite of the addition of the confidence clip 2. Instead of adding components to secure the safety pin and complicating the technology, the PosiKey system reduces the number of components and associated failure modes from current technology.

The improved safety clip 20 in the PosiKey system truly serves a safety function by preventing the PosiKey from being removed from the fuze/grenade assembly, prior to the removal of safety clip 20.

With the safety lever 16 in the compressed and unlocked position, the PosiKey can be extracted using a thumb action of the throwing hand similar to that used to remove the safety clip 20, which theoretically allows one hand operation in extreme combat conditions, e.g., non-throwing hand is incapacitated.

Unlike the current technology wherein components can result in pin extraction through material deformation, the PosiKey system of interlocking component feature interfaces cannot be extracted. Even if a portion of key 24 were to suffer from a material failure, the portion of the key internal to the grenade would continue to lock the grenade until the lever is compressed. Should such an event occur, the grenade can still be functioned by compressing the safety lever and allowing the locking residual to fall out. If material failure ever occurred with the PosiKey system, the primary failure mode of the locking key would occur external to the grenade and the residual key internal to the grenade would continue to lock the system.

Advantageously, existing inventory can be retrofitted with the PosiKey system as proven by the construction of a working model using surplus materiel.

The present invention consists of a system of current technology components with the addition of improvement features that accommodate the PosiKey system locking interface. The system has slots or openings 18 and 26 through the safety lever and fuze body. Slots 18 and 26 are directed towards the grenade inward along a line perpendicular to the safety lever pivot point. These slots are aligned when the safety lever 16 is in the fully compressed position as when gripped and squeezed by the operator's hand. The required compressing force is not altered from that required for the current technology's baseline. Interfacing key 24 is made from spring steel and is formed according as illustrated in FIG. 12 or 13 and machined to create multiple standoffs and recesses, cut-outs or notches 28, which align respectively with the fuze body and safety lever 16 material in the area of their slots. The standoffs and recesses allow the safety lever 16 to close the slots when the compressing force is removed, allowing the current technology spring-loaded striker to move the safety lever 16 and current technology striker into a locked position with key 24. Key 24 includes aligned portions of material that is not removed and serves as standoffs in the improved fuze body slots and to lock against the inside and outside of the improved safety lever 16 side material. A shoulder is created on key 24 to serve as a positive stop and to properly align the standoffs and recesses with the improved fuze body and safety lever 16 when key 24 is fully inserted. A third recess is also cut in key 24 to correspond with the striker that also creates an interfacing locking function. Once in the locked position, a total of three interfaces prevent key 24 from being removed from the improved fuze/grenade assembly. These multiple recesses are what create multiple opportunities for the operator to reconsider a decision to function the grenade. As can be seen in the figures notches 28 extend from an edge of key 24 in a direction which is generally perpendicular to the direction in which key 24 is removed from the fuzed device. A portion of lever 16 is positioned in notches 28 when key 24 is precluding the arming of the detonation device.

The remaining material of key 24 in the area of the recesses/cut-outs prevents the current technology spring-loaded striker and improved safety lever from further movement, having a material cross section with yield strength greater than that of the current technology split pin used for the same purpose.

On the operator side of the key's positive stop shoulder, the protruding flat steel is further formed to create an external tab that wraps back 180 degrees as shown in several of the figures and traverses the width of safety lever 16, ending in a catch formed from the tab (shown as clip or tab 30) that detents on the opposite side of safety lever 16. This external tab is formed to not compress the improved safety lever when in the locked position. The tab is also sufficiently formed to catch on the opposite side of safety lever 16 when safety lever 16 is in the fully compressed position. The catch serves to retain key 24 when lever 16 is in the compressed and unlocked position wherein slots 18 and 26 in the fuze body and safety lever 16, and the current technology striker are aligned to otherwise allow the free extraction of key 24. This catch feature adds a mode of safety for key extraction. The wrap around tab also includes a narrowing of its cross section to reduce bending stress on the shoulder area of key 24 and allows the catch to spring into place around safety lever 16.

Alternately, a key 24 may be formed with recesses to lock on the fuze body. In this manner, the key is shown in FIG. 13. However, this alternative reduces the number of locking interfaces by not providing a locking interface with the striker.

To prevent safety lever 16 from being inadvertently compressed from its locked position during stowage, i.e., the environment of transported loose cargo storage or temporary handling trays or pouches, a new safety clip hole 22 is created on the insertion side of the improved fuze body that traps the end of the improved safety clip 20 and creates an opposing force as the improved safety clip 20 latches on the opposite side of safety lever 16. An improved safety clip 20 is created by culminating in a blunt tip that is inserted into the hole. The improved safety clip 20 is formed to conform to the mating side surfaces of the safety lever and create an interference/spring fit around the safety lever 16 sides when inserted into the said safety clip hole 22.

Once the improved safety clip 20 is inserted into hole 22 in the improved fuze body, the edge of the improved safety lever 16 is constrained and lever 16 is prevented from inadvertent compression, thereby preventing key 24 from being removed and ultimately locking the improved fuze/grenade assembly until clip 20 is removed and lever 16 is compressed.

Should the PosiKey not become fully extracted from the grenade for any circumstance or reason, such as operator incapacitation, the improved system will relock the grenade upon release of the safety lever 16. This cannot be accomplished with current technology.

With the improved safety lever 16 in the compressed and unlocked position, the PosiKey allows one-handed operation using the thumb catch on the external tab.

This invention may be implemented into any hand grenade that uses a spring-loaded striker under a safety lever without requiring radical modification of current technology to implement. Most grenades in the world use a split pin through the fuze and across the striker to impede grenade function. The PosiKey not only impedes grenade function, but also eliminates the characteristic of pull force associated with current technology pull rings and split pins.

Advantageously, this PosiKey system can be implemented into new production as well as retrofitted into existing inventory for both grenade assemblies and practice fuze assemblies.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fuzed device, comprising:

a lever mechanism;

a detonator associated with said lever mechanism, a removal of said lever mechanism from the fuzed device subsequently initiating a detonation;

a locking key interacting with said lever mechanism to preclude an arming of said detonator until said locking key is removed from said lever mechanism, said locking key having at least one notch therein, a portion of said lever mechanism being positioned in said at least one notch when said locking key has precluded the arming of said detonator, said locking key being removed from the fuzed device before said lever mechanism can be removed; and a safety clip associated with said lever mechanism to preclude the removal of said locking key until said safety clip is disassociated from said lever mechanism, once said safety clip is disassociated from said lever mechanism said lever mechanism must be depressed before said locking key can be removed, once said locking key is removed if said lever mechanism is depressed said locking key may be reinserted into said lever mechanism, said at least one notch being positioned to interact with part of said lever mechanism to preclude removal of said locking key when said lever mechanism is not pressed toward the fuzed device, said at least one notch extending from an edge of said locking key in a direction generally normal to the direction in which said locking key is removed from said lever mechanism.

2. The fuzed device of claim 1, wherein said locking key has a non-circular cross section.

3. The fuzed device of claim 2, wherein said at least one notch is a plurality of notches.

4. The fuzed device of claim 2, wherein said non-circular cross section prevents rotation of said locking key relative to said lever mechanism.

5. The fuzed device of claim 1, further comprising a spring-loaded striker held in position by said lever mechanism.

6. The fuzed device of claim 1, wherein said locking key is in contact with more than one portion of said lever mechanism.

7. A fuzed device, comprising:

a lever mechanism;

a detonator associated with said lever mechanism, a removal of said lever mechanism from the fuzed device subsequently initiating a detonation; and a locking key interacting with said lever mechanism to preclude an arming of said detonator until said locking key is removed from said lever mechanism, said locking key having a plurality of notches therein, a portion of said lever mechanism being positioned in at least one of said plurality of notches when said locking key has precluded the arming of said detonator, said locking key being removed from the fuzed device before said lever mechanism can be removed, said plurality of notches include a first notch and a second notch, said first notch engaging one side of said lever mechanism and said second notch engaging another side of said lever mechanism wherein said locking key has a non-circular cross section.

* * * * *